United States Patent [19]

Epstein

[11] 4,106,944

[45] Aug. 15, 1978

[54] HARDENABLE COMPOSITIONS

[75] Inventor: David Epstein, London, England

[73] Assignee: National Research Development Corporation, England

[21] Appl. No.: 675,274

[22] Filed: Apr. 9, 1976

[30] Foreign Application Priority Data

Apr. 10, 1975 [GB] United Kingdom ..... 14822/75

[51] Int. Cl.[2] ..... B28B 7/34

[52] U.S. Cl. ..... 106/38.2; 106/38.35; 164/43; 260/29.6 S; 260/29.6 H; 260/42

[58] Field of Search ..... 106/35, 38.2, 38.22, 106/38.3, 38.35; 260/42, 29.6 S, 29.6 H; 164/43

[56] References Cited

U.S. PATENT DOCUMENTS 3,473,599 10/1969 Rose ..... 106/38.3

3,804,794 4/1974 Schmitt et al. ..... 106/35

3,929,493 12/1975 Lee et al. ..... 106/35

FOREIGN PATENT DOCUMENTS 1,316,129 5/1973 United Kingdom.

*Primary Examiner*—Lorenzo B. Hayes

*Attorney, Agent, or Firm*—Jacobs & Jacobs

[57] ABSTRACT

Particulate refractory material, e.g. foundry sand, is formed into cores, moulds and other shapes with the use of a binder comprising an ion-leachable inorganic particulate material and an organic polybasic acid or a precursor thereof which reacts with the ion-leachable inorganic particulate material in the present of water to form a binder which hardens the composition. Suitable binders are the polycarboxylate cements formed, for example, by reaction under aqueous conditions between zinc oxide or aluminosilicate glasses and polymeric acids such as acrylic acid polymers or copolymers.

4 Claims, No Drawings

HARDENABLE COMPOSITIONS

This invention relates to hardenable compositions for use with refractory materials, and is more particularly concerned with hardenable compositions for use as binders for sand cores and moulds in foundry practice.

In the production of metal castings, foundry moulds and cores are produced by mixing a particulate refractory material with a binder, forming the composition into the desired shape and allowing it to harden. For example, it has been proposed in British Pat. Nos. 1,366,705, 1,276,502 and 1,029,057 to mix foundry sand with a binder comprising inter alia a water soluble alkali metal silicate. However, these compositions are not wholly satisfactory in that their setting is often difficult to control and they do not produce moulds and cores having a very good surface. In addition, the setting time of certain of these compositions is dependent upon ambient temperature conditions.

According to the present invention a hardenable composition comprises a particulate refractory material, an ion-leachable inorganic particulate material and an organic polybasic acid or a precursor thereof which reacts with the ion-leachable inorganic particulate material in the presence of water to form a binder which hardens the composition.

The particulate refractory material may, for example, comprise a refractory oxide or silicate, and particularly those refractory minerals customarily used in foundry technology, for example silica sand, crushed olivine rock, chromite sand and zircon sand. Mixtures of any of these refractory materials may also be used. The particulate refractory materials are usually of particle size below 150 B.S. mesh, and preferably from 45 to 100 B.S. mesh, for example about 50 B.S. mesh. Mixtures of materials of different particle size may be used to improve packing.

Suitable substances for use as binders in accordance with the present invention include those materials known as the polycarboxylate cements. These materials are formed by reaction under aqueous conditions between a cation source from which cations can be leached out under acid conditions and a polyanionic substance, the product being a cement of great mechanical strength. Such cements have been eminently successful in recent years in the field of dentistry. The art of foundry practice is however considerably remote from that of dentisty and the requirements of a binder for sand cores and moulds are quite distinct from those of dental cements. In particular small quantities of binder must be effective in achieving good adhesion to and cohesion of large quantities of sand grains so that the product can withstand the rough handling conditions of foundry practice and also the temperatures of molten metal. Furthermore, the binder must have properties such that the core collapses at a certain stage in the casting technique.

The ion-leachable inorganic particulate material is one from which cations can be leached under acidic conditions. It may, for example, comprise a di- or polyvalent metal oxide, such as zinc oxide, to which there may be added up to about 10% by weight of other metal oxides such as, for example, magnesium oxide. The metal oxide is preferably deactivated by heat treatment as described in British Patent No. 1139430. The metal oxide may if desired be replaced by a salt of the di- or polyvalent metal with a weak acid, the weak acid being capable of an exchange reaction with the polyacid used. For example, zinc oxide may be wholly or partially replaced by zinc borate. Alternatively the ion-leachable inorganic particulate material may comprise a fused oxide made by heating a mixture of simple oxides to fusion temperature, or an oxide glass, for example a glass comprising calcium or sodium oxide with alumina and silica. The preferred ion-leachable materials for use in the present invention are aluminosilicate glasses, wherein the ratio by weight of acidic to basic oxides in the glass is such that the glass will react with an organic polybasic acid in the presence of water to produce a set cement. Suitable aluminosilicate glasses may, for example, be prepared by fusing mixtures of alumina, silica and calcium oxide in the appropriate proportions, together with, if necessary, up to 30% by weight, based on the total weight of the composition of a flux which may be a fluoride, a borate, a phosphate, or a carbonate. Most preferaby the ion-leachable inorganic particulate material comprises a fluoroaluminosilicate glass, for example as described and claimed in British Patent No. 1,316,129, wherein the ratio by weight of silica to alumina is from 1.5 to 2.0 and the ratio by weight of fluorine to alumina is from 0.6 to 2.5, or wherein the ratio by weight of silica to alumina is from 0.5 to 1.5 and the ratio by weight of fluorine to alumina is from 0.25 to 2.0. The fluoroaluminosilicate glasses may be prepared by fusing mixtures of silica, alumina, cryolite, and a fluoride in the appropriate proportions at temperatures above 950° C.

Other ion-leachable materials may be used including alloys such as ferrosilicon and acid decomposable silicate minerals such as ortho- and pyrosilicates, cyclic and chain silicates based on recurring metasilicate units and aluminosilicates with a threedimensional lattice wherein the ratio of Al:Si exceeds 2:3.

The degree of fineness of the ion-leachable inorganic particulate material should preferably be such that the hardenable composition sets in the desired shape within an acceptable period. Preferably the degree of fineness of the ion-leachable inorganic particulate material is such that it will pass through a 350 B.S. mesh sieve. Where the ion-leachable inorganic material comprises an aluminosilicate glass, this may be used in the form of glass fibres if desired.

The organic polybasic acid may be a simple aliphatic or aromatic acid comprising a plurality of acid groups, for example tartaric acid and p-toluene sulphonic acid but is preferably a polymeric polyacid which reacts with the ion-leachable inorganic particulate material to form a poly (carboxylate) cement. Mixtures of organic polybasic acids may be used, and also mixtures of the organic polybasic acids with inorganic acids.

The preferred polymeric polyacids are poly(carboxylic acid)s prepared by the homopolymerisation and copolymerisation of unsaturated aliphatic carboxylic acids, for example acrylic acid, itaconic acid, mesaconic acid, citraconic acid, aconitic acid, and maleic acid and copolymerisation of these acids with other unsaturated aliphatic monomers, for example acrylamide and acrylonitrile. Particularly preferred are the homopolymers of acrylic acid, and its copolymers, particularly with itaconic acid. Good results may also be obtained using copolymers of vinyl methyl ether and maleic acid. Any suitable route may be used for the preparation of the poly(carboxylic acid) and, for example, polyacrylic acid may be prepared by hydrolysis of polyacrylonitrile. It is also possible to use a precursor of a poly(carboxylic acid) which will be transformed into the poly(carboxylic acid) on contact with water, for example, a poly(carboxylic acid anhydride) or other suitable polymer. The poly(carboxylic acid anhydride) may be a homopolymer of an unsaturated carboxylic acid anhydride, or a copolymer with a vinyl monomer, and particularly a vinyl hydrocarbon monomer. Good results may be obtained using homopolymers of maleic anhydride, and copolymers thereof with ethylene, propene, butene and styrene. Other polymeric polyacids which may be used include poly(vinyl phthalic acid).

The polymeric polyacid is preferably linear, although branched polymers may also be used, and preferably has an average molecular weight of from 1,000 to 100,000 and most preferably from 10,000 to 100,000. In this specification the average molecular weight is defined as being that measured by gel permeation chromatography.

The hardenable composition may be stored in any suitable form, provided that means are provided to prevent reaction of the ion-leachable particulate material with the polybasic acid in the presence of water. Thus the composition may be stored as a dry powder comprising an intimate mixture of the particulate refractory material, the ion-leachable particulate material and the powdered polybasic acid or precursor thereof. Where the polybasic acid or precursor thereof is in powdered form, it preferably has a degree of fineness such that it will pass through a 150 B.S. mesh sieve. In many cases, however, it is found that mixing is improved by using the polybasic acid in the form of an aqueous solution, which may contain from 20 to 65% by weight of the polybasic acid.

The ion-leachable inorganic particulate material and the organic polybasic acid which together make up the binder are preferably present in the hardenable composition in an amount of up to about 20% by weight, particularly from 1 to 10% by weight, such as for example about 2% by weight. The polybasic acid and the ion-leachable inorganic particulate material are preferably present in the ratio of 1 to 100 parts by weight of ion-leachable inorganic particulate material for each 10 parts by weight of the polybasic acid or precursor thereof.

In use, the components of the hardenable composition are mixed and water is added if necessary. Depending on the ratio of the individual components, the composition can retain its plastic properties for a period of from 1 to 30 minutes, during which time it may be cast or moulded, or otherwise formed into the desired shape prior to hardening.

The hardenable compositions of the present invention may be used to produce moulds, moulding cores, and refractory linings for a variety of purposes, but are particularly useful in the foundry industry for producing moulds and cores for metal casting.

The invention is illustrated by the following Examples: To simplify presentation of the data, the Examples are written in partly generalised form using a, b, c, etc. to signify the quantities of components used. Numerical values of a, b, c, etc. are then tabulated.

EXAMPLES 1 to 4

Chelford 50 sand (100 kg) is thoroughly mixed with (a) Kg. of a fluoroaluminosilicate glass prepared according to Example 2 of British Patent No. 1316129 and then with (b) liters of a (c) % w/v aqueous solution of the acid or acid precursor (d). Mixing is completed within three minutes and the sand rammed in a wooden core box. A setting time of (e) minutes is typical for the composition and after 24 hours it attains a hardness of (f) on the Ridsdale-Dietert core hardness tester scale.

| Ex. No. | 1 | 2 | 3 | 4 |
|---|---|---|---|---|
| a | 6 | 3 | 5 | 6 |
| b | 4 | 5 | 5 | 4 |
| c | 50 | 48 | 20 | 20 |
| d | tartaric acid | polyacrylic acid | ethylene-maleic anhydride copolymer (Monsanto EMA31) | ethylene-vinyl methyl ether copolymer (Gaf Gantrex S95) |
| e | 60 | 30 | a few | 30 |
| f | 80 | 82 | >60 | 80 |

EXAMPLES 5 to 7

Chelford 50 sand (100 kg.) is thoroughly mixed with (a) Kg. of deactivated zinc oxide (Durelon manufactured by ESPE) and then with (b) liters of a (c) solution of the acid (d). Mixing is completed within a few minutes and the sand rammed in a wooden core box. A setting time of (e) minutes is usual for the composition and after 24 hours it attains a hardness of (f) on the Ridsdale-Dietert core hardness tester.

| Ex. No. | 5 | 6 | 7 |
|---|---|---|---|
| a | 4 | 3 | 3 |
| b | 6 | 6 | 6 |
| c | 48% w/v aqueous | 50% w/v aqueous | 15% w/v aqueous-acetone |
| d | poly(acrylic) acid | tartaric acid | poly(vinylphthalic acid) |
| e | 5 | 4 | 5 |
| f | 60 | 61 | 60 |

EXAMPLE 8

Sand cores were prepared as described in Examples 2, 3 and 4 and used in sand casting of grey iron. The binders were found to have excellent adhesive properties for sand binding, and a good dimensional accuracy of castings was observed. Upon cooling the metal the cores were easily broken down to facilitate removal of the broken up sand from the interior of the casting.

I claim:

1. In a hardenable foundry composition that can be formed into the shape of a foundry core or mould and hardened, comprising an inert particulate refractory material selected from refractory oxides and silicates and binder ingredients that react to form a cured binder that hardens the composition, the improvement which consists of the use as binder ingredients of a particulate aluminosilicate glass and an aqueous solution of a polymer of acrylic acid that will leach cations from the glass to form the reacted binder, and in which the amount of the said binder ingredients is from 1 to 10% by weight of the composition.

2. A composition according to claim 1 in which the particulate aluminosilicate glass is finer than 350 BS mesh and the refractory material is coarser than 150 BS mesh.

3. A composition according to claim 1 in which the polymer of acrylic acid is selected from homopolymers of acrylic acid and copolymers of acrylic acid with itaconic acid and has a molecular weight of 10,000 to 100,000.

4. A composition according to claim 1 in which the aluminosilicate glass is a fluoroaluminosilicate glass.

* * * * *